United States Patent [19]

Fage

[11] Patent Number: 4,511,953

[45] Date of Patent: Apr. 16, 1985

[54] THEATRICAL LIGHT BOX

[76] Inventor: Bonnard Fage, 100 Wompatuck St., Hingham, Mass. 02043

[21] Appl. No.: 650,894

[22] Filed: Sep. 17, 1984

[51] Int. Cl.[3] ..... F21V 9/00

[52] U.S. Cl. ..... 362/230; 362/240; 362/249; 362/250; 362/269; 362/287; 362/293; 362/367; 362/374; 362/375

[58] Field of Search ..... 362/230, 240, 249, 250, 362/287, 269, 293, 367, 374, 375

[56] References Cited

U.S. PATENT DOCUMENTS

| | | | |
|---|---|---|---|
| 1,141,122 | 6/1915 | Kliegl | 362/153 |
| 4,259,709 | 3/1981 | Eddings | 362/240 |
| 4,385,346 | 5/1983 | Spicer | 362/806 |

*Primary Examiner*—Stephen J. Lechert, Jr.

[57] ABSTRACT

This invention is directed at a light box comprising a box-like base member and a cover. The base member has a storage compartment and a series of light chambers which are aligned with the storage chamber. The storage chamber includes a means of providing power to the source of light mounted in the light chambers. The cover is pivotally engaged to the base member by an L hinge and has an adjustable connector extending therefrom which is engageable with the base member. Each of the secondary walls has an upper side edge and a lower side edge. The upper side edge is positioned in close proximity to the opening of the base member and the lower side edge is positioned in spaced parallel relation to the upper side edge and has a notch formed therein. The notches of the secondary walls are in aligned, spaced relation to each other. A first channel is mounted in a shoulder formed at the opening to the base member and faces into the light chambers. A series of inward facing channels are mounted in the light compartment adapted to cooperate with the first channel to hold a filter or the like in parallel relation to the base. The first channel is spaced from the top side edge of the base member providing an opening into the light chambers and the bottom wall of the base member has at least one vent formed therethrough. The base has a platform portion mounted thereon within the storage chamber. The platform portion is spaced from the inner surface of the base and has a connector mounted thereon facing into the storage chamber.

12 Claims, 10 Drawing Figures

THEATRICAL LIGHT BOX

BACKGROUND OF THE INVENTION

This invention relates generally to theatrical lighting and more specifically to a rectangular light box including a primary compartment and a series of light compartments.

SUMMARY OF THE INVENTION

An object of the present invention is to provide a generally rectagular light box comprising a box-like base member and a cover. The box includes a storage compartment and a series of three light compartments which are aligned with each other and with the storage compartment. The cover is pivotally engaged to the base member and has an adjustable connector extending therefrom which is engageable with the base member.

Another object of the present invention is to provide a light box which has a storage chamber for storing the electric lines of the light box and which has a means of providing power to the source of light.

It is an additional object of the present invention to provide a light box which has a series of spaced, parallel secondary walls which divide the compartments into a storage chamber and light chambers. Each of the secondary walls has an upper side edge and a lower side edge, the upper side edge in close proximity to the opening of the base member of the light box. Each of the lower side edges is in spaced parallel relation to an upper side edge and has a notch formed therein. The notches are in aligned, spaced relation to each other.

Another object of the present invention is to provide a light box wherein the top wall has a top side edge and has a width less than the width of the bottom wall and the height of the secondary wall, the top side edge of the top wall thereby forming a shoulder with the bottom wall and the secondary wall. A first channel is mounted in the shoulder, facing into the light chamber, and a a series of inward facing channels are mounted in the light compartment and are adapted to cooperate with the first channel to hold a filter or the like in parallel relation to the base.

A still further object of the present invention is to provide a light box in which the first channel is spaced from the top side edge defining an opening into a light chamber and the bottom wall has at least one vent formed therethrough opening into a light chamber.

Another object of the present invention is to provide a light box in which the adjustable member is formed of an elastic material, such as rubber or device, such as a helical spring.

Another object of the present invention is to provide a light box whose base has an inner surface on which a platform portion is mounted. The platform portion is positioned within the storage chamber, is spaced from the inner surface and has a connector mounted thereon facing into the storage chamber.

BRIEF DESCRIPTION OF THE DRAWINGS

Further details are explained below with the help of the examples illustrated in the attached drawings in which:

FIG. 4 is a top view of the light box shown in FIG. 1 with the light bulb and connector dotted in;

FIG. 5 is a side elevational view of the light box, shown in FIG. 1, with the light bulbs and connector dotted in;

DESCRIPTION OF THE PREFERRED EMBODIMENT(S)

Figure 2:
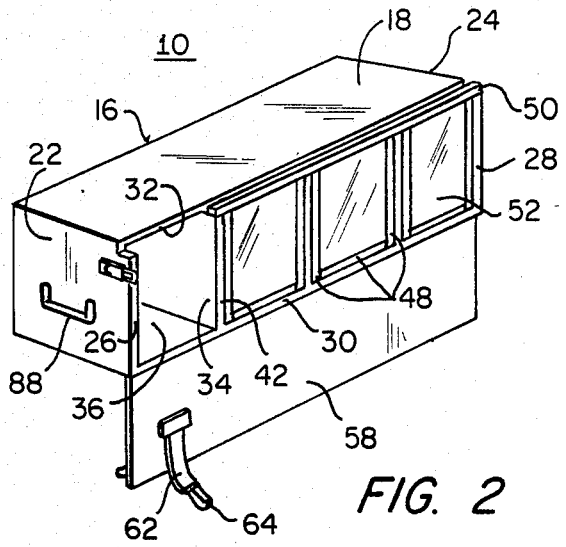
FIG. 2 is an isometric view of the light box shown in FIG. 1, with the cover open.
Figure 1:
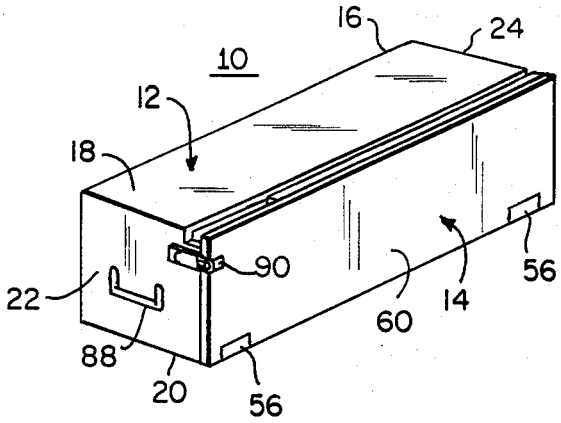
FIG. 1 is an isometric view of a light box according to the present invention with the cover closed.
Figure 3:
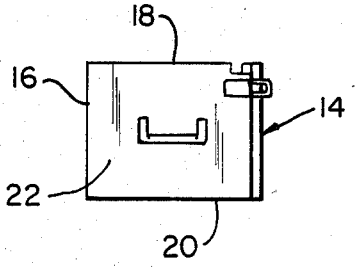
FIG. 3 is end elevational view of the light box shown in FIG. 1.
Figure 4:
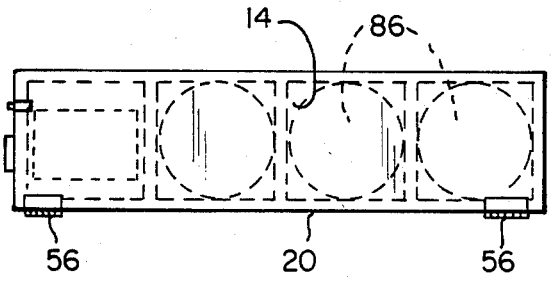
Figure 5:
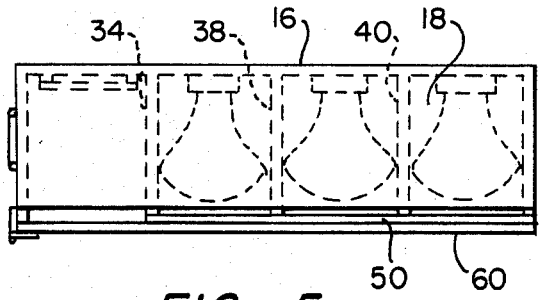
Figure 6:
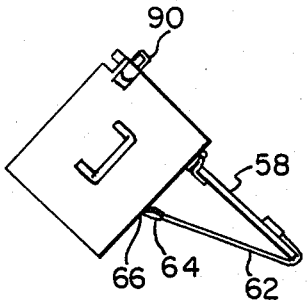
FIG. 6 is a top view of the light box shown in FIG. 1 with the cover open and the adjustable member engaged.
Figure 7:
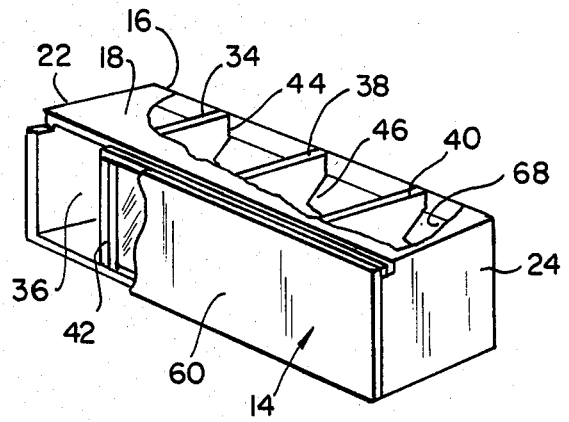
FIG. 7 is an isometric view of the light box shown in FIG. 1 with the cover and first wall broken away.
Figure 8:
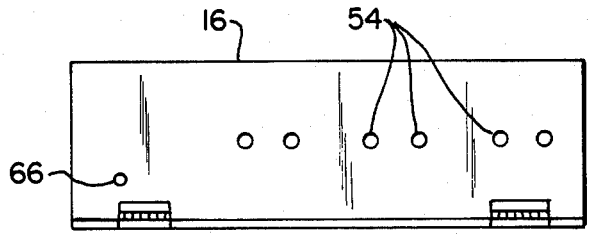
FIG. 8 is a bottom plan view of the light box shown in FIG. 1.
Figure 9:
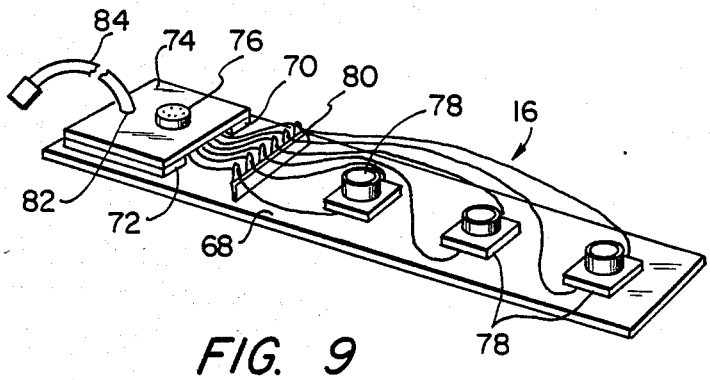
FIG. 9 is an isometric view of the base of the light box shown in FIG. 1 with the connector bar, platform and sockets in position
Figure 10:
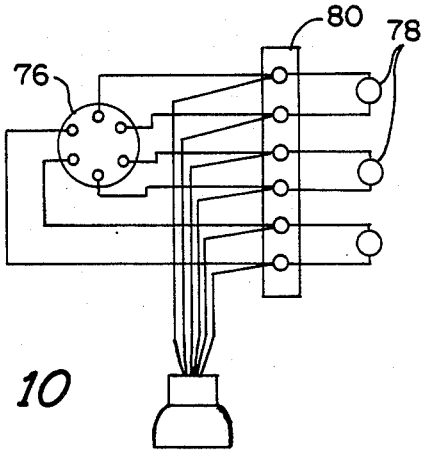
FIG. 10 is a schematic of the electrical elements of the light box shown in FIG. 1.

There is shown in the drawings a light box 10 comprising a box-like base member 12 and a cover 14. The base member 12 having a base 16, first wall 18, a second wall 20, a top wall 22 and a bottom wall 24. The first wall 18, second wall 20, top wall 22 and bottom wall 24 extending in right angle relationship to and from the base 16. The first wall 18 is in spaced parallel relation to the second wall 20 with the top wall 22 and the bottom wall 24 in spaced parallel relation to each other and in right angle relation to the first and second walls 18, 20. The base 16, first wall 18, second wall 20, top wall 22, and bottom wall 24 defining a primary compartment. The top wall 22 has a top side edge 26 and has a height greater than the width of the first wall 18 and equal to the width of the second wall 20 and the height of the bottom wall 24; the first wall 18 thereby forming a shoulder with the top and bottom walls 22, 24. The bottom wall 24 includes a first free edge 28, the second wall 20 has a free edge 30 and the first wall 18 includes a forward free edge 32. The top side edge 26, the free edge 30 and the first free edge 28 lie on the same horizontal plane defining an opening with the forward free edge 32 of the first wall 18 which lies on a different horizontal plane. A first secondary wall 34 extends in right angle relation for most of the width of the first wall 18 to most of the width of the second wall 20 forming a storage chamber 36 with the top wall 22. The top wall 22 is in spaced parallel relationship with the first secondary wall 34. A second secondary wall 38 and a third secondary wall 40 are each positioned in spaced parallel relation to the first secondary wall 34 to provide three light chambers. The walls of each of the light chambers acts as a bulb support. Each of the first, second and third secondary walls 34, 38, 40 includes an upper side edge 42 and a lower side edge 44. The upper side edge 42 is positioned in close proximity to the opening of the base member 12 and each of the lower side edges 44 is in spaced parallel relation to an upper side edge 42, has a notch 46 formed therethrough and is spaced from the horizontal plane defined by the "bottom" edges of the first wall 18, the second wall 20, the top wall 22 and the bottom wall 24 providing a recess shoulder. The notches 46 of the first, second and third secondary walls 34, 38, 40 are aligned for a purpose to be setforth hereinafter. Rectangular, aluminum channels 48, which are open on one side, are attached to the second wall 20, the first secondary wall 34 and the second secondary wall 38 in close proximity to the opening of the base member 12 and facing into a light chamber. Similar aluminum channels 48, which are open on one side, are attached to the third secondary wall 38, the second wall 20 and the opposite side of the second secondary wall 38 in close proximity to the opening of the base member 12 and facing into a light chamber and are attached to the bottom wall 24, the second wall 20 and the opposite side of the third secondary wall 40 in close proximity to the opening of the base member 12 and facing into a light chamber. A long aluminum channel 50 is attached to the side edge of the first, second and third secondary walls 34, 38, 40 and to the bottom wall 24 in close proximity to the opening of the base member 12, facing into the light chambers and spaced from the forward free edge 32 of the first wall 18. The aluminum channels 48 and the long aluminum channel 50 are adapted to hold light filters 52 at the opening of each light chamber as will be explained hereinafter. A pair of circular, vent holes 54 are formed through the second wall 20 at each light compartment. The cover 14 is pivotally engaged to the second wall 20 through the use of a pair of shutter type "L" hinges 56. The cover 14 includes an inner surface 58 and a top surface 60 to which a portion of the L hinges 56 is attached and to the external surface of the second wall 20. One of the L hinges 56 is positioned in close proximity to the bottom wall 24 and the other is positioned in close proximity to the top wall 22. A strip like adjustable member 62 is attached, at one of its ends, to the inner surface 58 of the cover 14. The adjustable member 62 may be of an elastic construction such as rubber or the like and includes a free terminal end having an engagement member 64, such as a hook, extending therefrom. The second wall 20 has a through aperture 66 which is spaced a predetermined distance from the top wall 22 and the base 16. The aperture 66 is adapted to be engaged by the engagement member 64 of the adjustable member 62 when the cover 14 is fully opened. The base 16 is generally rectangular in configuration and has an inside surface 68. The inside surface 68 has first and second support portions 70, 72 extending in right angle relation thereto. The first support portion 70 is adjacent a first long edge of the base 16 and the second support portion 72 is adjacent the opposite long edge of the base 16. A platform portion 74 is mounted on the first and second support portions 70, 72 in the area of the storage chamber 36. The platform portion 74 is in spaced, parallel relation to the inside surface 68 and has a multi pin polarized connector 76 mounted thereon facing into the storage chamber 36. The connector 76 is adapted to engage a standard male 120 volt socket. A light socket 78, adapted to accept a lamp 86, is mounted on the inside surface 68 of the base 16 in the area of and facing into each of the light chambers. The walls of the light chambers may act as a lamp support. A connector bar 80 is attached to the inside surface 68 of the base 16 between the assembly of the platform portion 74, the first support portion 70 and second support portions 72 and the first light socket 78. A through opening 82 is formed in the platform portion 74 permitting passage of a power cable 84 through the opening 82 and between the platform portion 74 and the inside surface 68. The power cable 84 is connected to the connector bar 80. The free end of the power cable 84 has a male connector attached thereto adapted to engage a standard 120 v socket. The connector 76 is electrically connected to the connector bar 80 and the light sockets 78 are connected in parallel to each other and to the connector bar 80. The connector 76 permits electrical connection with another light box (not shown). The base 16 with its above mentioned electrical and structural elements is press fitted into the primary compartment as indicated in FIG. 4. Since as stated hereinbefore the lower side edge 44 of the secondary walls 34, 38 and 40 is spaced inward of the "bottom" edges of the first wall 18, the second wall 20, the top wall 22 and the bottom wall 24, the base 16 will be butted against the lower side edge 44 and recessed as indicated in FIG. 5. Venting of the individual light chambers is provided by the vent holes 54 and the space between the long channel 50 and the forward free edge 32 of the first wall 18. When the cover 14 is closed the inside surface 68 bears against the top side edge 26 of the top wall 22, the first free edge 28 of the bottom wall 24 and the long channel 50. In use the light box 10 can be mounted on the bottom wall 24 with the cover 14 held in the open position, shown in FIG. 6, by the connection of the engagement member 64 with the through aperture 66 of the second wall 20. The light box 10 can also be mounted on the free edge of the cover 14 and the edge of the second wall 20 remote from the free edge 30, with the cover 14 held in the open position by the connection of the engagement member 64 with the through aperture 66 of the second wall 20. The connection of the engagement member 64 with the through aperture 66 of the second wall 20 stretches the engagement member 64, which may be formed of rubber or other stretchable material or constructions.

What I claim is:

1. A light box comprising a box-like base member and a cover, the base member having a base, first wall, a second wall, a top wall and a bottom wall, the first wall, second wall, top wall and bottom wall extending from the base 16 with the first wall in spaced parallel relation to the second wall and the top wall and the bottom wall in spaced parallel relation to each other and in right angle relation to the first and second walls; the base, first wall, second wall, top wall and bottom wall defining a primary compartment; the bottom wall having a first free edge and the first wall, second wall and top wall having free edges, the free edges of the first wall, second wall, top wall and the first free edge of the bottom wall lying on the same horizontal plane defining an opening, the cover having an inner surface, an outer surface, a first side edge and a second side edge, the first side edge of the cover pivotally engaged to the first free edge, the second side edge having an adjustable connector extending therefrom and engageable with the base member, the primary compartment having an electric light mounted therein whereby the base member may be positioned on a flat surface resting on the second side edge and the edge defined by the juncture of the base and the bottom wall.

2. A light box comprising a box-like base member and a cover, the base member including a base and a bottom wall, the bottom wall extending in right angle relationship from the base, the bottom wall having a first free edge and the base member including an opening, the cover having a first side edge and a second side edge, the first side edge of the cover pivotally engaged to the bottom wall, the cover having an adjustable connector extending therefrom and engageable with the base member, the base member having a source of light mounted therein whereby the base member may be positioned on a flat surface with the source of light illuminating a target.

3. A light box as set forth in claim 2 wherein the base member includes a first wall, a second wall and a top wall, the first wall, second wall, top wall and bottom wall extending from the base, the first wall in spaced parallel relation to the second wall, the top wall and the bottom wall in spaced parallel relation to each other and in right angle relation to the first and second walls, the base, first wall, second wall, top wall, and bottom wall defining a primary compartment, at least one secondary wall extending from the top wall to the bottom wall forming at least two chambers, one of the chambers including a means of providing power to the source of light.

4. A light box as set forth in claim 3 wherein the secondary wall has an upper side edge and a lower side edge, the upper side edge in close proximity to the opening of the base member and the lower side edge in spaced parallel relation to the upper side edge and having a notch formed therein.

5. A light box as set forth in claim 3 wherein the top wall has a top side edge and has a width less than the width of the bottom wall and the height of the secondary wall, the top side edge of the top wall thereby forming a shoulder with the bottom wall and the secondary wall, a first channel mounted in the shoulder and facing into the light chamber, a series of inward facing channels mounted in the light compartment adapted to cooperate with the first channel to hold a filter or the like in parallel relation to the base.

6. A light box as set forth in claim 5 wherein the first channel being spaced from the top side edge providing an opening into the light chamber and the bottom wall having at least one vent formed therethrough.

7. A light box as set forth in claim 2 wherein the adjustable member is of an elastic construction.

8. A light box as set forth in claim 2 wherein the cover is pivotally engaged to the bottom wall through the use of a shutter type "L" hinge.

9. A light box as set forth in claim 3 having at least two secondary walls and at least three chambers formed thereby and the storage chamber includes a multi pin polarized connector permitting parallel electric connection of a second light box.

10. A light box as set forth in claim 3 wherein the base has an inner surface, the inner surface having a platform portion mounted thereon within the storage chamber, the platform portion spaced from the inner surface and having a connector mounted thereon facing into the storage chamber.

11. A light box as set forth in claim 9 wherein two of the chambers are light chambers and the top wall has a top side edge and has a width less than the width of the bottom wall and the height of the secondary wall, the top side edge of the top wall thereby forming a shoulder with the bottom wall and the secondary wall, a first channel mounted in the shoulder and facing into the light chamber, a series of inward facing channels mounted in the light compartment adapted to cooperate with the first channel to hold a filter or the like in parallel relation to the base in each of the light chambers.

12. A light box as set forth in claim 11 wherein each of the secondary walls has an upper side edge and a lower side edge, the upper side edge in close proximity to the opening of the base member and the lower side edge and having a notch formed therein, the notches in aligned, spaced relation to each other.

* * * * *